US006926175B2

(12) United States Patent
Choi et al.

(10) Patent No.: US 6,926,175 B2
(45) Date of Patent: Aug. 9, 2005

(54) CONSTANT DISCHARGE STRUCTURE FOR NOZZLE HEAD LOWERING TYPE VACUUM COSMETIC CONTAINER

(75) Inventors: Hee Jin Choi, Seoul (KR); Yu Kwang Oh, GyeongGi-Do (KR)

(73) Assignee: CDR Co., LTD, Seong Nam Si (KR)

( * ) Notice: Subject to any disclaimer, the term of this patent is extended or adjusted under 35 U.S.C. 154(b) by 0 days.

(21) Appl. No.: 10/783,694

(22) Filed: Feb. 23, 2004

(65) Prior Publication Data

US 2005/0109797 A1 May 26, 2005

(30) Foreign Application Priority Data

Nov. 26, 2003 (KR) ..... 10-2003-0084414

(51) Int. Cl.[7] ..... B65D 88/54

(52) U.S. Cl. ..... 222/321.7; 222/321.9; 222/321.1; 222/383.1; 222/183; 222/340

(58) Field of Search ..... 222/321.6–321.9, 222/383.1, 340, 321.1–321.2, 385, 105, 380, 222/183, 321.4, 386, 336; 417/557, 546, 417/547, 550, 511, 552

(56) References Cited

U.S. PATENT DOCUMENTS 4,435,135 A * 3/1984 Knickerbocker ..... 417/511
4,726,747 A * 2/1988 Skorka ..... 417/489
5,271,532 A * 12/1993 Jumel et al. ..... 222/321.9
5,518,377 A * 5/1996 Bougamont et al. ..... 417/446
5,813,571 A * 9/1998 Gaucher ..... 222/95
6,010,036 A * 1/2000 Bougamont et al. ..... 222/183
6,196,424 B1 * 3/2001 Bougamont et al. ..... 222/321.9
6,763,978 B2 * 7/2004 Pritchett et al. ..... 222/321.7

FOREIGN PATENT DOCUMENTS

KR 10-1998-0702906 4/1998

* cited by examiner

*Primary Examiner*—Frederick C. Nicolas
(74) *Attorney, Agent, or Firm*—Park & Sutton LLP; John K. Park

(57) ABSTRACT

Disclosed is a constant discharge structure for a nozzle head lowering type vacuum cosmetics container for containing high functional cosmetics. The constant discharge structure includes a liquid collecting chamber having a liquid inflow hole in the lower portion of a piston support member mounted in the container, a groove having an inclined short jaw, a support jaw and a liquid inlet hole and an open/close unit for opening/closing the liquid inflow hole in the lower portion of a central shaft, an elastic pumping member being inserted into the groove of the shaft and including a hole having an inner wall for opening/closing the liquid inlet hole on a flat surface unit, and a cylinder incorporated inside a piston for supporting the central shaft.

6 Claims, 10 Drawing Sheets

CONSTANT DISCHARGE STRUCTURE FOR NOZZLE HEAD LOWERING TYPE VACUUM COSMETIC CONTAINER

CLAIMING FOREIGN PRIORITY

The applicant claims and requests a foreign priority, through the Paris Convention for the Protection of Industry Property, based on a patent application filed in the Republic of Korea (South Korea) with the filing date of Nov. 26, 2003, with the patent application number 10-2003-0084414, by the applicant. (See the Attached Declaration).

BACKGROUND OF THE INVENTION

1. Field of the Invention

The present invention relates to a structure for discharging a constant amount of contents in a nozzle head lowering type vacuum cosmetics container for containing high functional cosmetics.

2. Description of the Related Art

In general, high functional cosmetics such as essence, lotion and cream for preventing or reducing wrinkles, facilitating whitening and intercepting ultraviolet rays include vitamins or natural extracts as main ingredients. Such ingredients are sensitive. When the ingredients are exposed to air (oxygen) or sunlight (ultraviolet rays), they are easily acidified.

In order to solve the foregoing problem, there has been suggested a constant discharge structure for an airless type cosmetics container. This structure is a nozzle head restoring type structure for pressing a nozzle head, discharging contents, and restoring the head. After the container is filled with contents and packed, an air layer exists in the upper portion of the container. Accordingly, the contents of the container always contact air (especially, oxygen), and thus are easily acidified due to interactions. In addition, the structure is quite complicated.

A contents discharge structure has been mentioned in 'Discharge Apparatus for liquid or paste material and assembly method thereof' under Korea Laid-Open Patent Application 1999-0066973. However, the contents discharge structure does not discharge a constant amount of contents but discharges the contents at a time by a pressure of a nozzle head.

SUMMARY OF THE INVENTION

It is, therefore, an object of the present invention to safely protect contents in a container from air and sunlight without acidification by filling the real contents in the container without having an idle air layer in the upper portion thereof after discharging the contents. Differently from a nozzle head restoring type airless cosmetics container, whenever a nozzle head is pressed, a contents pumping member is lowered by a predetermined distance, the real contents are discharged according to the lowering distance, and a contents inflow hole is closed by a valve formed in the lower end of a central shaft to prevent the nozzle head from being more lowered, thereby discharging a constant amount of contents.

To achieve the above object, there is provided a constant discharge structure for a nozzle head lowering type vacuum cosmetics container, the vacuum cosmetics container including: a container for containing liquid cosmetics; a sealing member for sealing up the bottom surface of the container; a nozzle head being assembled to the upper portion of the container and having a nozzle hole; a piston member built in the container, for closely adhering an elastic rib to the inner wall of the container; a piston support member having a cylinder, the piston member being fixed to the piston support member; a central shaft having a liquid passage, the nozzle head being inserted into the upper end of the central shaft; and a spring for applying elasticity to the nozzle head, the constant discharge structure including: a central shaft guide cylinder formed in the center of the piston member in a single body, a lower portion of the central shaft being inserted into the cylinder; a liquid collecting chamber formed in the lower portion of the piston support member; a liquid inflow hole formed on the bottom surface of the piston support member to be linked to the liquid collecting chamber and a cosmetics liquid containing chamber of the container; a groove having a downwardly-inclined short jaw in its upper portion and a support short jaw in its lower portion on the lower wall of the central shaft; an open/close unit formed in the lower end of the central shaft, for opening/closing the liquid inflow hole; a liquid inlet hole punched on the groove; and an elastic pumping member having its hole punched on a flat surface unit and inserted into the groove so that its inner wall can open/close the liquid inlet hole of the groove, and being mounted on the central shaft so that its outer circumferential wall can be closely adhered to the inner wall of the cylinder of the piston support member.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
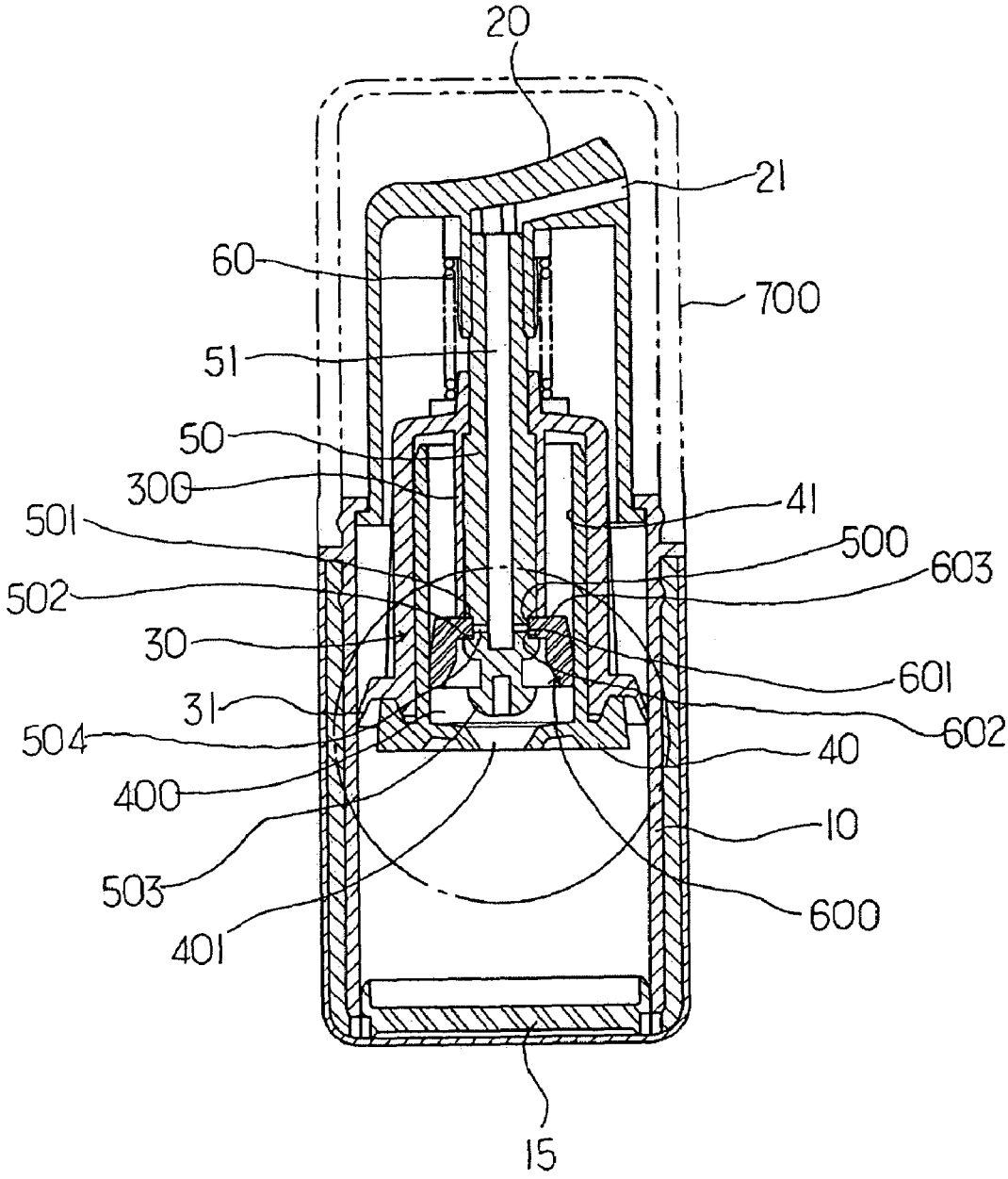
FIG. 1 is a vertical-sectional diagram illustrating a state where liquid is sucked from a container by using an elastic pumping member in accordance with one preferred embodiment of the present invention.

Preferred embodiments of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

In a nozzle head lowering type vacuum cosmetics container comprised of a container 10 for containing liquid cosmetics, a sealing member 15 for sealing up the bottom surface of the container 10, a nozzle head 20 being assembled to the upper portion of the container 10 and having a nozzle hole 21, a piston member 30 built in the container 10, for closely adhering an elastic rib 31 to the inner wall of the container 10, a piston support member 40 having a cylinder 41, the piston member 30 being fixed to the piston support member 40, a central shaft 50 having a liquid passage 51, the nozzle head 20 being inserted into the upper end of the central shaft 50, and a spring 60 for applying elasticity to the nozzle head 20, a constant discharge structure includes a central shaft guide cylinder 300 formed in the center of the piston member 30 in a single body, a lower portion of the central shaft 50 being inserted into the cylinder 300, a liquid collecting chamber 400 formed in the lower portion of the piston support member 40, a liquid inflow hole 401 formed on the bottom surface of the piston support member 40 to be linked to the liquid collecting chamber 400 and a cosmetics liquid containing chamber of the container 10, a groove 500 having a downwardly-inclined short jaw 501 in its upper portion and a support short jaw 502 in its lower portion on the lower wall of the central shaft 50, an open/close unit 503 formed in the lower end of the central shaft 50, for opening/closing the liquid inflow hole 401, a liquid inlet hole 504 punched on the groove 500, and an elastic pumping member 600 having its hole 601 punched on a flat surface unit 603 and inserted into the groove 500 so that its inner wall 602 can open/close the liquid inlet hole 504 of the groove 500, and being mounted on the central shaft 50 so that its outer circumferential wall can be closely adhered to the inner wall of the cylinder 41 of the piston support member 40.

Figure 5:
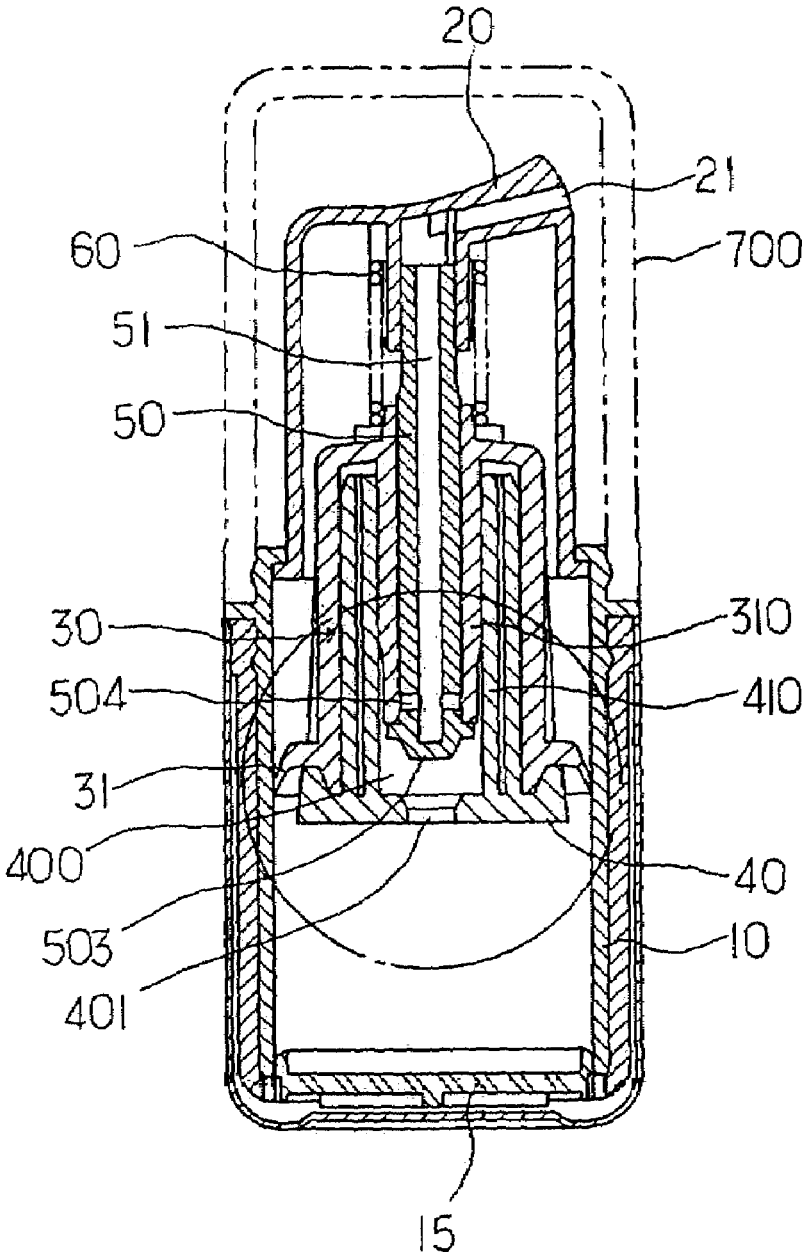
FIG. 5 is a vertical-sectional diagram illustrating a state where liquid is sucked in accordance with another preferred embodiment of the present invention.
Figure 6:
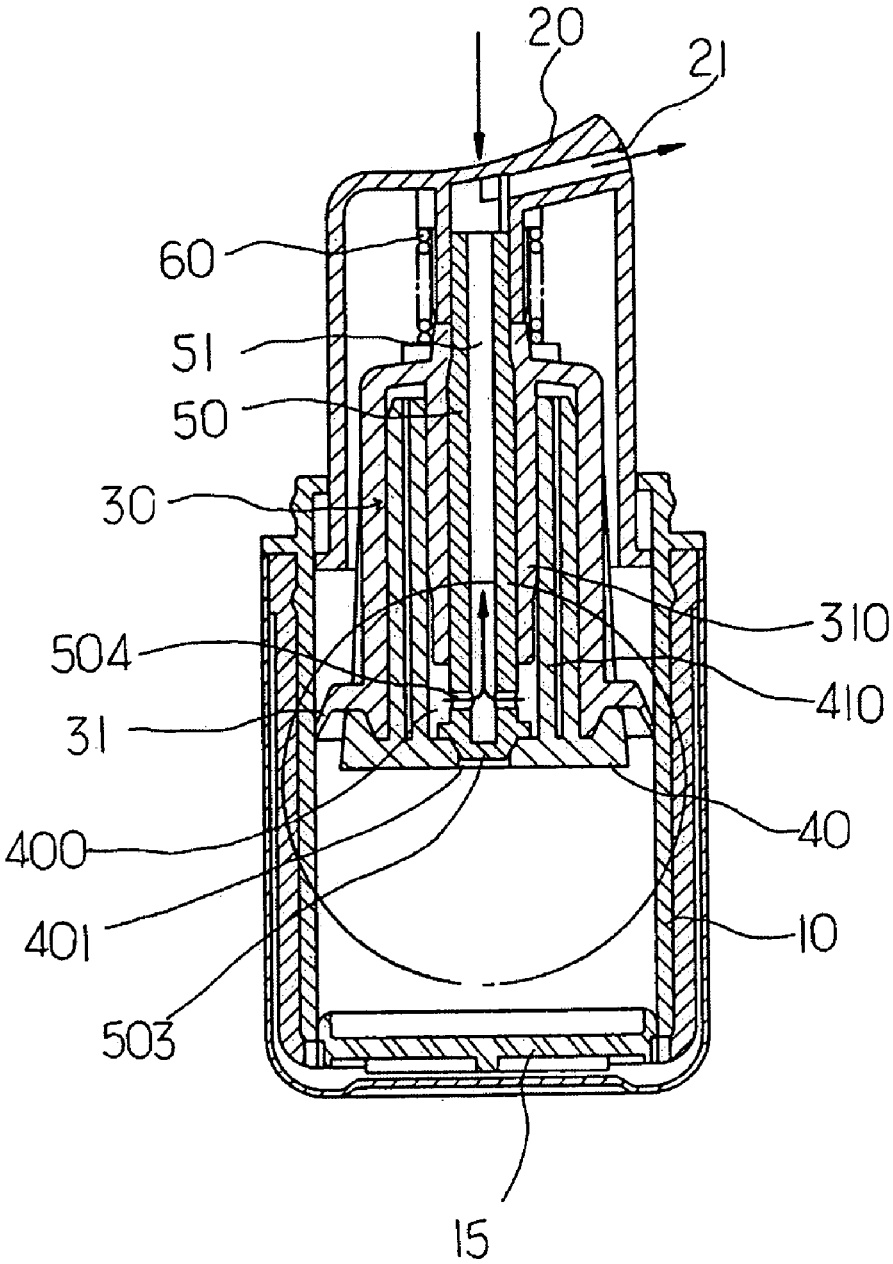
FIG. 6 is a vertical-sectional diagram illustrating a state where the liquid is discharged in accordance with another preferred embodiment of the present invention.
Figure 7:
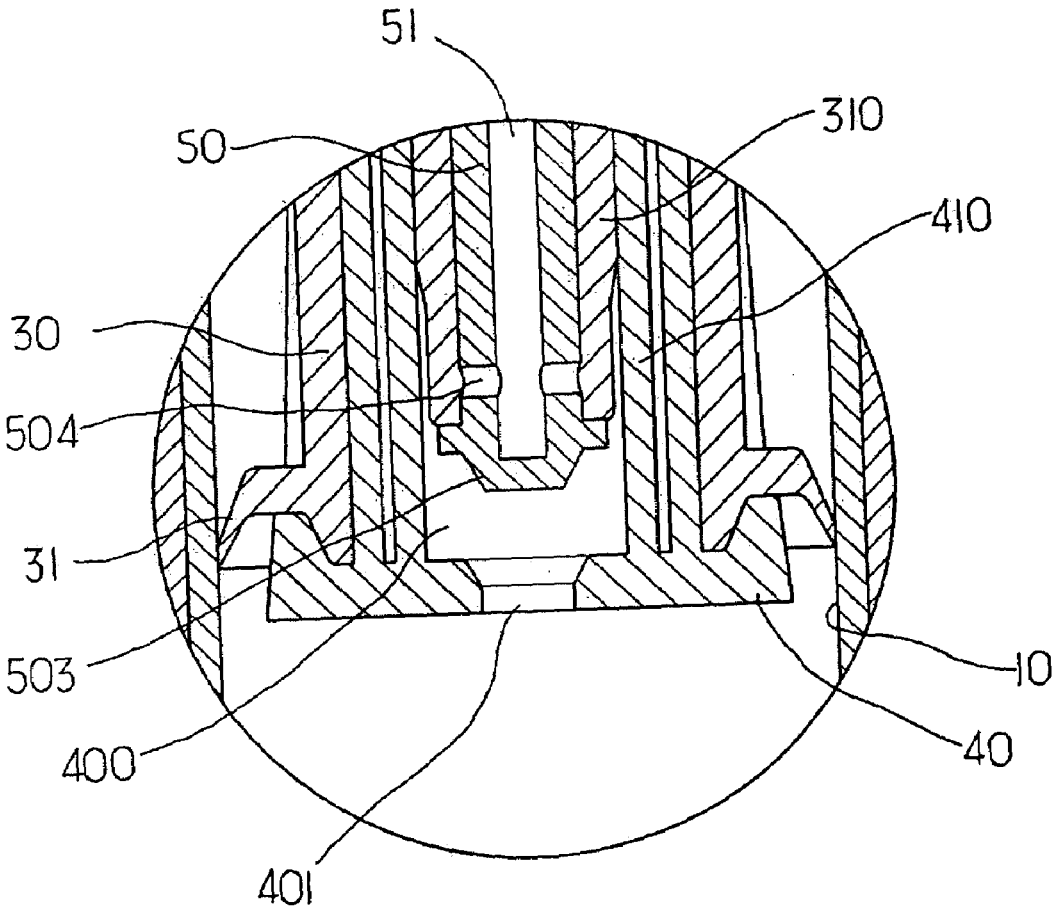
FIG. 7 is an enlarged cross-sectional diagram illustrating a state where the liquid is sucked from the container, taken by a circular portion of FIG. 5.
Figure 8:
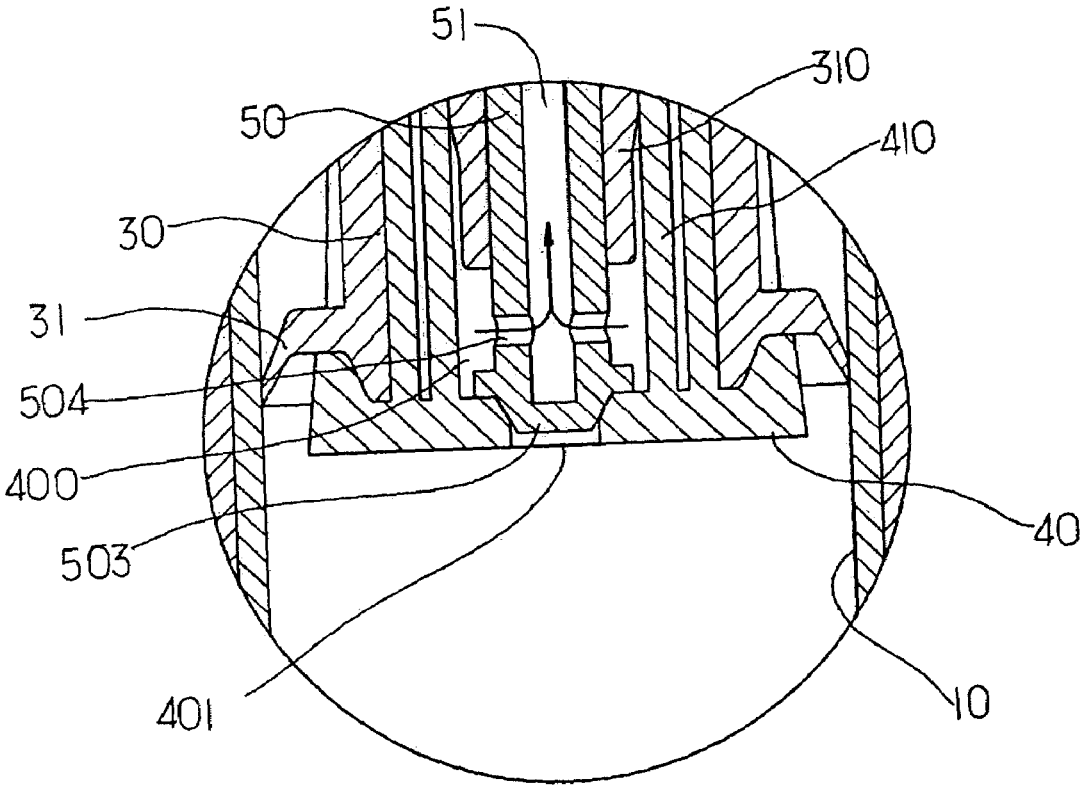
FIG. 8 is an enlarged cross-sectional diagram illustrating a state where the sucked liquid is discharged, taken by a circular portion of FIG. 6.
Figure 9:
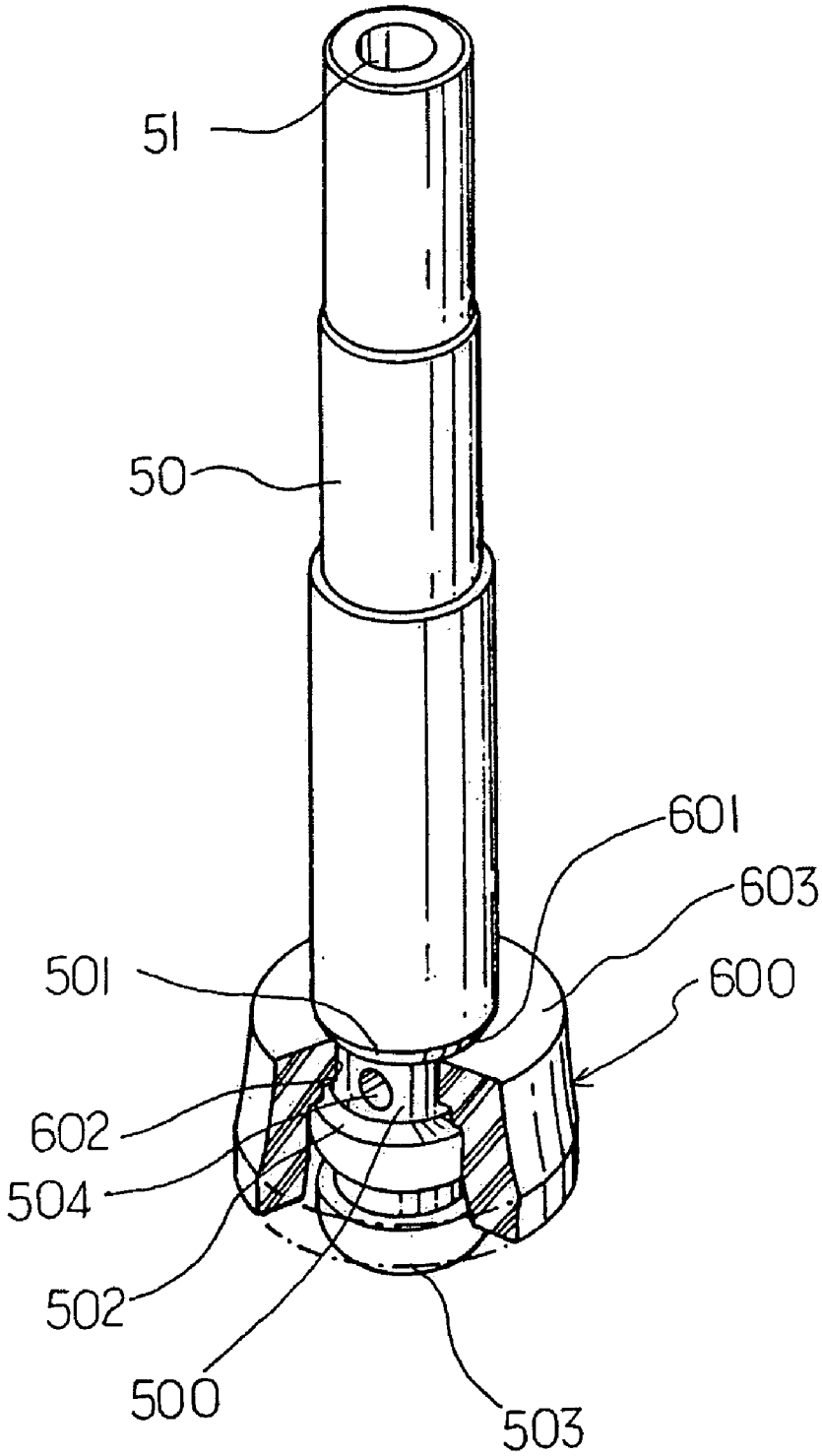
FIG. 9 is a perspective diagram illustrating major elements of the constant discharge structure using the elastic pumping member in accordance with one preferred embodiment of the present invention.
Figure 10:
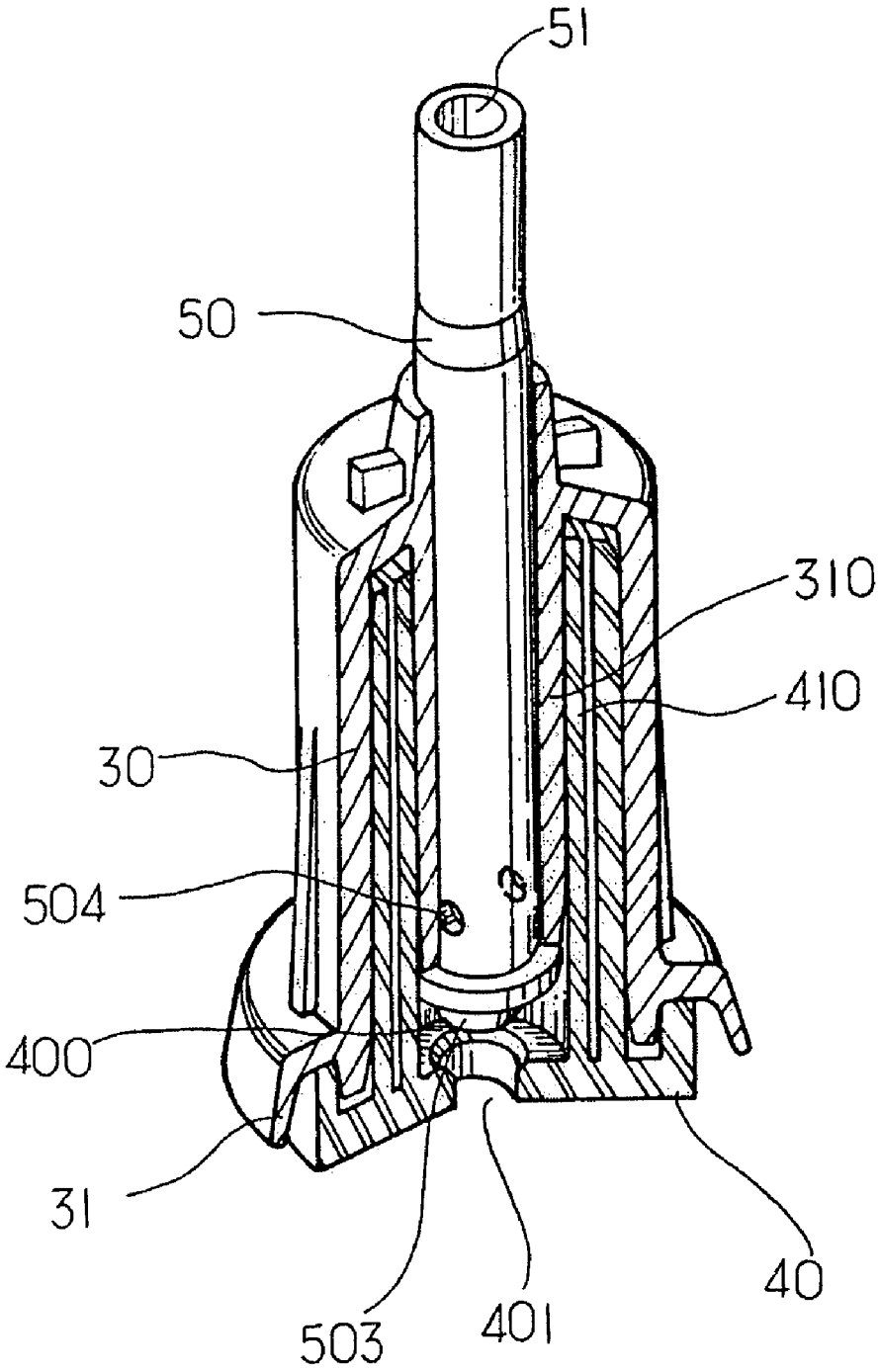
FIG. 10 is a perspective diagram illustrating major elements of the constant discharge structure using a cylindrical pumping body in accordance with another preferred embodiment of the present invention.

FIGS. 5 and 6 illustrate a constant discharge structure which simplifies the whole constitution in accordance with another embodiment of the present invention. In order to discharge a constant amount of contents without using the elastic pumping member 600, a cylindrical pumping body 310 closely adhered to a body of the central shaft 50 having the open/close unit 503 in its lower end is incorporated with the piston member 30, and lifted/lowered in a pumping cylinder 410 incorporated with the piston support member 40. Accordingly, the cylindrical pumping body 310 directly opens/closes the liquid inlet hole 504 punched on the central shaft 50.

Reference numeral 700 denotes an over-cap.

The operational effects of the present invention will now be explained.

The contents are contained through the bottom surface of the container 10. The sealing member 15 is inserted into the container 10 to generate a pressure in the container 10. When the elastic pumping member 600 is opened due to the pressure, the contents may be discharged through the liquid inlet hole 504. However, the central shaft guide cylinder 300 presses the flat surface unit 603 of the elastic pumping member 600, and thus the elastic pumping member 600 is not opened, to prevent the contents from being discharged while being contained.

The liquid cosmetics contained in the container 10 maintain a completely sealed state by the piston member 30 or the sealing member 15 without having an air layer in the container 10.

FIG. 1 shows a state where the nozzle head 20, the central shaft 50 fixed to the nozzle head 20, and the elastic pumping member 600 inserted into the groove 500 of the central shaft 50 are lifted due to an elastic force of the spring 60 positioned between the piston member 30 and the nozzle head 20. In this state, the liquid cosmetics in the container 10 flow through the liquid inflow hole 401 into the liquid collecting chamber 400 formed in the lower portion of the cylinder 41 of the piston support member 40.

Figure 2:
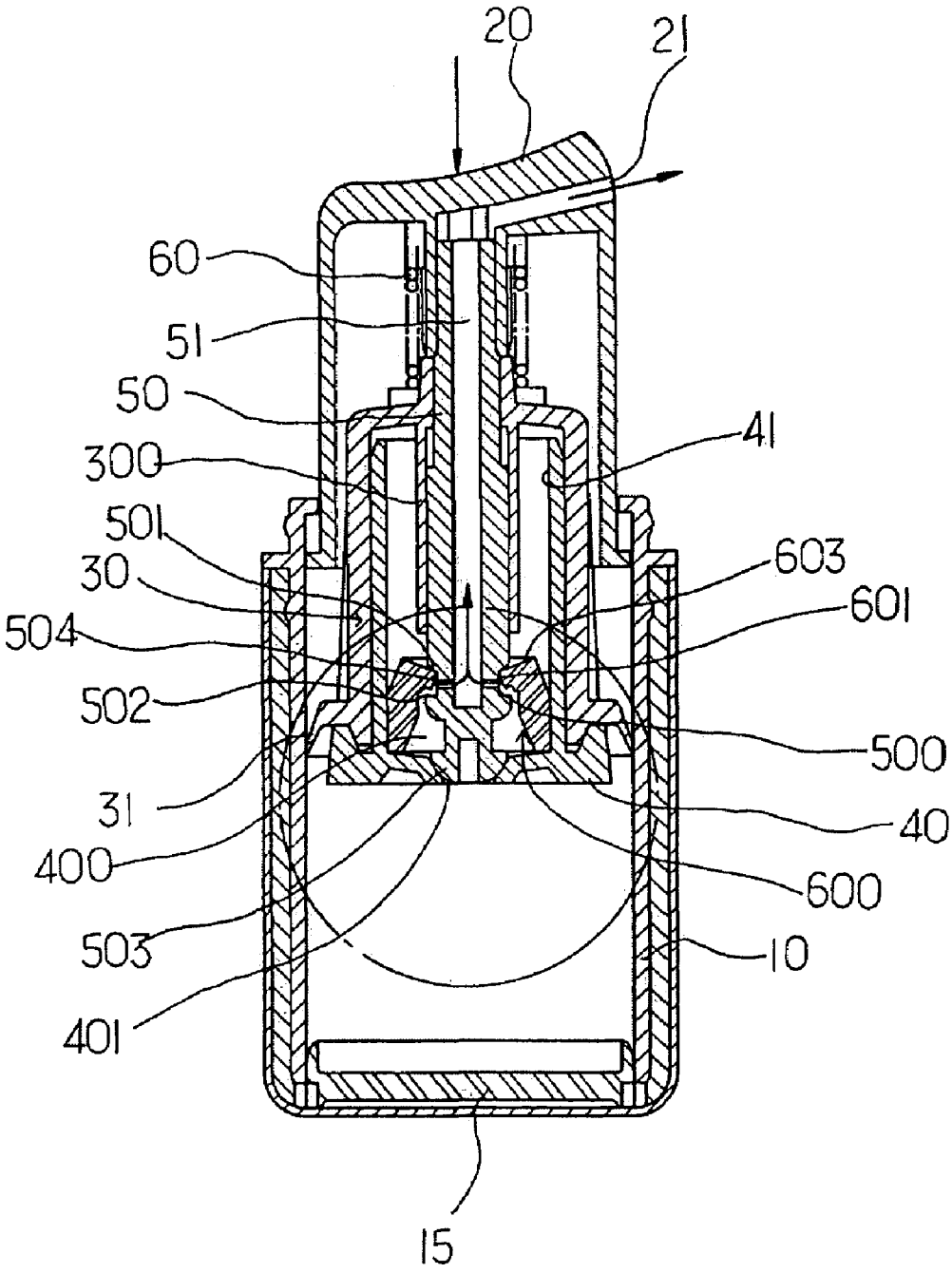
FIG. 2 is a vertical-sectional diagram illustrating a state where the liquid sucked by the elastic pumping member is discharged in accordance with one preferred embodiment of the present invention.
Figure 3:
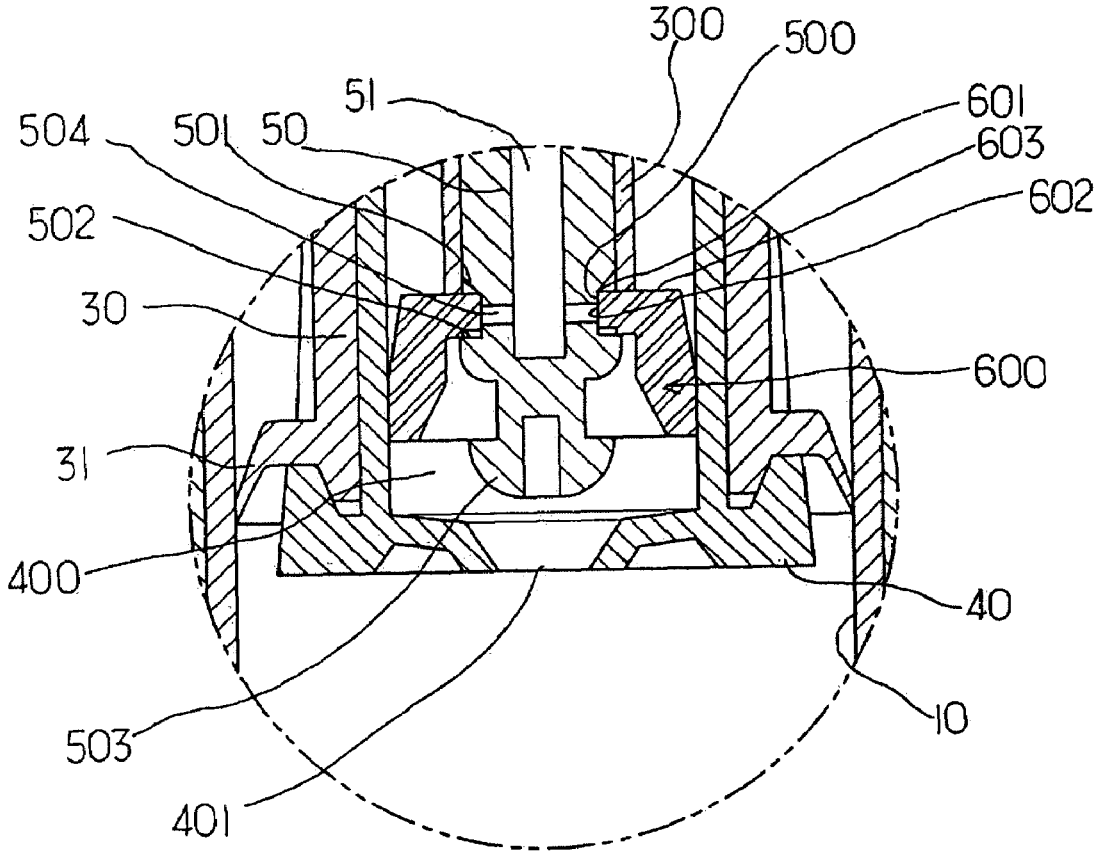
FIG. 3 is an enlarged cross-sectional diagram illustrating a state where the liquid is sucked from the container, taken by a circular portion of FIG. 1.
Figure 4:
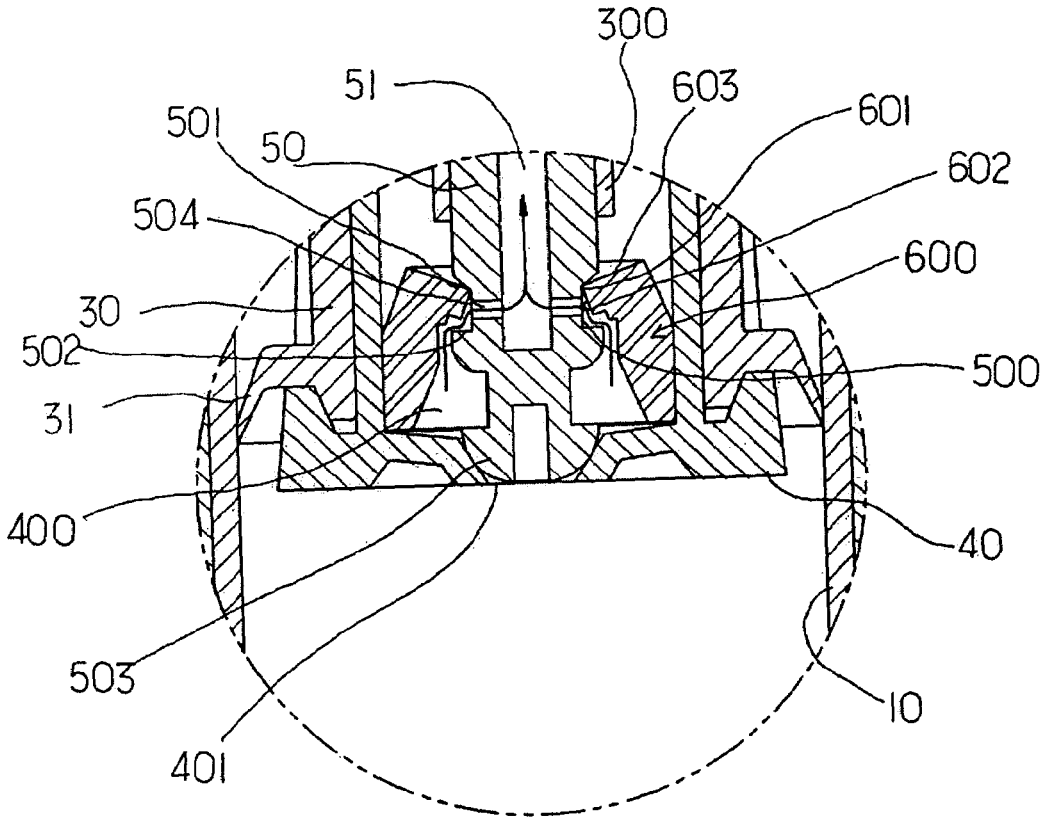
FIG. 4 is an enlarged cross-sectional diagram illustrating a state where the sucked liquid is discharged, taken by a circular portion of FIG. 2.

Here, in order to discharge the liquid cosmetics, when the nozzle head 20 lifted as shown in FIG. 2 is pressed, the nozzle head 20, the central shaft 50 and the elastic pumping member 600 are lowered at the same time. In a state where the open/close unit 503 formed in the lower end of the central shaft 50 closes the liquid inflow hole 401, the pressure of the elastic pumping member 600 which is constantly lowered is applied to the liquid cosmetics in the liquid collecting chamber 400, to increase the pressure of the liquid collecting chamber 400. When the central shaft 50 presses the elastic pumping member 600, the flat surface unit 603 of the elastic pumping member 600 is inwardly crushed and closely adhered to the inner wall of the groove 500. Therefore, the lower portion of the inner wall 602 of the hole 601 closing the liquid inlet hole 504 is opened (refer to FIGS. 2 and 4), so that the liquid cosmetics in the liquid collecting chamber 400 can flow into the liquid passage 51 of the central shaft 50 through the liquid inlet hole 504 and be discharged to the nozzle hole 21 of the nozzle head 20.

The short jaw 501 formed in the upper portion of the groove 500 is downwardly inclined. When the central shaft 50 is lowered, the short jaw 501 of the central shaft 50 presses the flat surface unit 603 of the elastic pumping member 600. Accordingly, the flat surface unit 603 is naturally inwardly crushed, and thus the lower portion of the inner wall 602 is opened.

In addition, when the open/close unit 503 of the central shaft 50 closes the liquid inflow hole 401, the liquid cosmetics do not flow through the liquid inflow hole 401. Thus, the nozzle head 20 is not any more lowered, and a constant amount of liquid cosmetics contained in the liquid collecting chamber 400 are discharged.

When the forcibly-pressed nozzle head 20 is released, the inner wall 602 of the elastic pumping member 600 closes the liquid inlet hole 504 due to the elastic force of the spring 60, and simultaneously the open/close unit 503 opens the liquid inflow hole 401. The liquid cosmetics in the container 10 flow into the liquid collecting chamber 400 due to a suction force generated by the lifting operation of the elastic pumping member 600. The piston member 30 and the nozzle head 20 are lowered according to the amount of the liquid cosmetics flowing into the liquid collecting chamber 400.

FIGS. 5, 6, 7 and 8 illustrate the constant discharge structure in accordance with another embodiment of the present invention.

The cylindrical pumping body 310 incorporated with the piston member 30 is lifted/lowered in the pumping cylinder 410 incorporated with the piston support member 40, to open/close the liquid inlet hole 504. When the nozzle head 20 is pressed to be lowered, the central shaft 50 is also lowered. The liquid inlet hole 504 punched on the central shaft 50 passes the lower end of the cylindrical pumping body 310. Therefore, the contents are discharged through the liquid inlet hole 504 due to a lowering pressure of the central shaft 50. When the central shaft 50 is lowered and the open/close unit 503 closes the liquid inflow hole 401, the contents are not any more discharged. It is thus much easier to discharge a constant amount of contents. The whole constitution is simplified by omitting the elastic pumping member 600, and the manufacturing process thereof is also simplified.

As discussed earlier, the constant discharge structure is very simple in constitution, does not generate an idle air layer causing acidification of the contents in the container, is easily operated, extends a preservation period of the contents due to improved sealing, and discharges a constant amount of contents by one easy pumping operation.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A constant discharge structure for a in which a nozzle head is lowered vacuum cosmetics container, the vacuum cosmetics container including: a container for containing liquid cosmetics; wherein the container includes a bottom surface, an upper portion and an inner wall a sealing member sealing up the bottom surface of the container; a nozzle head being assembled to the upper portion of the container and having a nozzle hole; a piston member built in the container, closely adhering an elastic rib to the inner wall of the container; a piston support member having a cylinder, the piston member being fixed to the piston support member; a central shaft having a liquid passage, an upper end and a lower end the nozzle head being inserted into the upper end of the central shaft; and a spring applying elasticity to the nozzle head, the constant discharge structure, comprising:

a central shaft guide cylinder formed in the center of the piston member in a single body, a lower portion of the central shaft being inserted into the cylinder;

a liquid collecting chamber being formed in the lower portion of the piston support member, and having a liquid inflow hole;

a constant discharge means having a groove formed in the lower portion of the central shaft and an elastic pumping member inserted into the groove for sucking/discharging liquid to/from the liquid collecting chamber; and a means for discharging a constant amount of contents by a cylindrical pumping body incorporated with the piston member, the central shaft being inserted into the means for discharging.

2. The structure of claim 1, wherein an open/close unit for opening/closing the liquid inflow hole is formed in the lower end of the central shaft.

3. The structure of claim 1, wherein the groove comprises a downwardly-inclined short jaw in its upper portion and a support short jaw in its lower portion, and a liquid inlet hole is punched on the inner wall thereof.

4. The structure of claim 1, wherein the elastic pumping member comprises a hole having an inner wall for opening/closing the liquid inlet hole on a flat surface unit.

5. The structure of claim 1, wherein the cylindrical pumping body is incorporated with the piston member.

6. The structure of claim 1, wherein the pumping cylinder is incorporated with the piston support member.

* * * * *